US011747046B2

(12) United States Patent
O'Donnell

(10) Patent No.: US 11,747,046 B2
(45) Date of Patent: Sep. 5, 2023

(54) HEAT EXCHANGER FOR WATER HEATER

(71) Applicant: BECKETT THERMAL SOLUTIONS, North Ridgeville, OH (US)

(72) Inventor: Michael J. O'Donnell, Avon, OH (US)

(73) Assignee: BECKETT THERMAL SOLUTIONS, North Ridgeville, OH (US)

( * ) Notice: Subject to any disclaimer, the term of this patent is extended or adjusted under 35 U.S.C. 154(b) by 0 days.

(21) Appl. No.: 17/588,913

(22) Filed: Jan. 31, 2022

(65) Prior Publication Data

US 2022/0243956 A1 Aug. 4, 2022

Related U.S. Application Data

(60) Provisional application No. 63/145,542, filed on Feb. 4, 2021.

(51) Int. Cl.

| | |
|---|---|
| ***F24H 9/00*** | (2022.01) |
| ***F28F 1/40*** | (2006.01) |
| ***F24H 1/00*** | (2022.01) |

(52) U.S. Cl.

CPC ..... *F24H 9/0031* (2013.01); *F24H 1/0027* (2013.01); *F28F 1/40* (2013.01)

(58) Field of Classification Search

CPC ..... B21C 37/225

See application file for complete search history.

(56) References Cited

U.S. PATENT DOCUMENTS

| | | | | |
|---|---|---|---|---|
| 2,687,747 | A | 8/1954 | Bock | |
| 2,950,740 | A | 8/1960 | Bock | |
| 3,349,754 | A | 10/1967 | Bock | |
| 3,600,548 | A | 8/1971 | Bock et al. | |
| 4,239,953 | A | 12/1980 | Bock | |
| 4,761,532 | A | 8/1988 | Bock | |
| 6,354,248 | B1 * | 3/2002 | Bourke | F24H 9/0026 122/18.31 |
| 6,957,629 | B1 | 10/2005 | Steinhafel et al. | |
| 7,836,856 | B2 | 11/2010 | Mullen et al. | |
| 8,807,093 | B2 | 8/2014 | Steinhafel | |
| 10,036,570 | B2 | 7/2018 | Zhang et al. | |
| 2016/0091222 | A1 * | 3/2016 | Lesage | F24H 1/186 110/162 |

FOREIGN PATENT DOCUMENTS

| | | | | |
|---|---|---|---|---|
| DE | 2927363 A1 * | 1/1981 | | F24H 1/186 |
| GB | 2498771 A * | 7/2013 | | F25B 15/00 |

* cited by examiner

*Primary Examiner* — Steven S Anderson, II
*Assistant Examiner* — Kurt J Wolford
(74) *Attorney, Agent, or Firm* — TAROLLI, SUNDHEIM, COVELL & TUMMINO L.L.P.

(57) ABSTRACT

A heat exchanger for a water heater having a burner includes a tube extending longitudinally along a centerline from a first end adjacent the burner to a second end. The tube defines a passage. Strips extend within the passage and are arranged about the centerline. Each strip includes a base and fins extending from opposite sides of the base such that flue gases from the burner flow from the first end to the second end of the outer tube and in channels between the fins.

10 Claims, 5 Drawing Sheets

HEAT EXCHANGER FOR WATER HEATER

RELATED APPLICATIONS

This application claims the benefit of U.S. Provisional Application 63/145,542, filed Feb. 4, 2021, the entirety of which is incorporated herein by reference.

TECHNICAL FIELD

The present invention relates generally to water heaters and more specifically to a flue tube heat exchanger for water heaters having enhanced heat transfer capability.

BACKGROUND

Storage type water heaters transfer heat primarily through the flue tube that runs through the center of the water tank. All of the flue tubes utilize some type of enhancement to extract heat from the flue gases passing therethrough. In one example, different types of baffles are employed to increase scrubbing of the flue tube walls to increase heat transfer. In another example, hundreds or even thousands of small metal tabs are welded to the inside walls of the flue tube to increase heat transfer. Each existing heat transfer enhancement can have inefficiency and/or cost issues.

SUMMARY

In one example, a heat exchanger for a water heater having a burner includes a tube extending longitudinally along a centerline from a first end adjacent the burner to a second end. The tube defines a passage. Strips extend within the passage and are arranged about the centerline. Each strip includes a base and fins extending from opposite sides of the base such that flue gases from the burner flow from the first end to the second end of the outer tube and in channels between the fins.

In another example, a heat exchanger for a water heater having a burner includes a tube extending longitudinally along a centerline from a first end adjacent the burner to a second end. The tube defines a passage. Strips extend within the passage and are arranged about the centerline. Each strip includes a base and fins extending from the base such that flue gases from the burner flow from the first end to the second end of the outer tube between and around the fins. The base extends along a centerline that is helical.

Other objects and advantages and a fuller understanding of the invention will be had from the following detailed description and the accompanying drawings.

DETAILED DESCRIPTION

Figure 1:
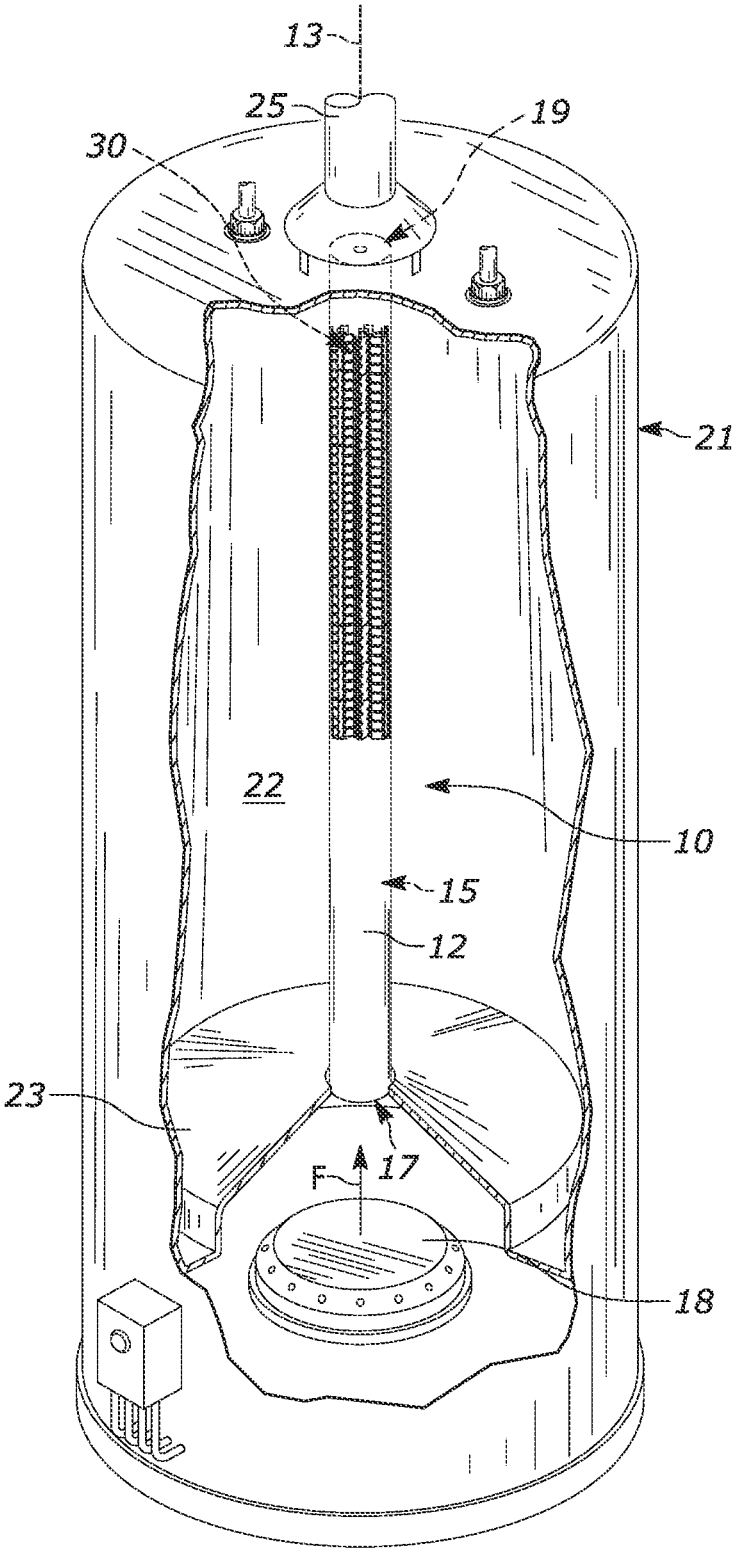
FIG. 1 is a schematic illustration of a water heater having an example flue tube heat exchanger.

The present invention relates generally to water heaters and more specifically to a flue tube heat exchanger for water heaters having enhanced heat transfer capability. Referring to FIG. 1, a gas heated residential water heater 21 is shown and defines a water heating chamber 22 in which water to be heated (not shown) is stored.

A gas burner 18 is provided at the bottom of the water heater 21. A partition 23 is secured to the interior of the water heater 21 above the gas burner 18 to isolate the gas burner from the stored water. A heat exchanger 10 extends from an opening in the partition 23 and upwards through the heating chamber 22 for transferring heat from flue gases produced by the gas burner 18 to the water within the heating chamber 22.

The heat exchanger 10 includes a flue tube 12 that extends longitudinally along a centerline 13 from a first/inlet end 17 or a second/outlet end 19. A passage 15 extends the entire length of the tube 12 between the ends 17, 19. The first end 17 extends through the partition 23 and is in fluid communication with the gas burner 18. The second end 19 extends to/is in fluid communication with an exhaust or vent system 25 at the top of the water heater 21. The tube 12 can be formed from metal or any material having high thermal conductivity.

Figure 2:
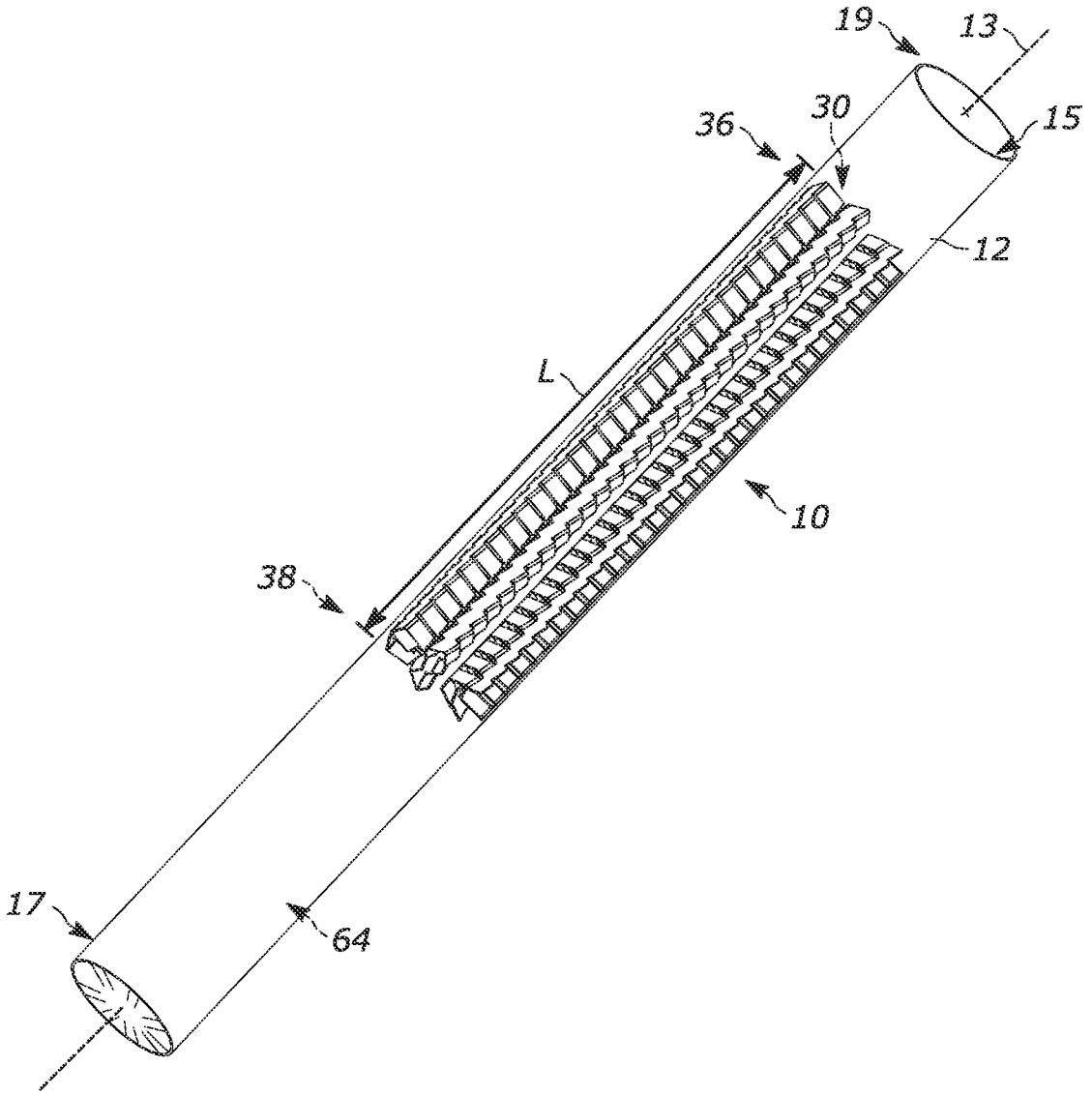
FIG. 2 is a front view of the heat exchanger of FIG. 1.
Figure 3:
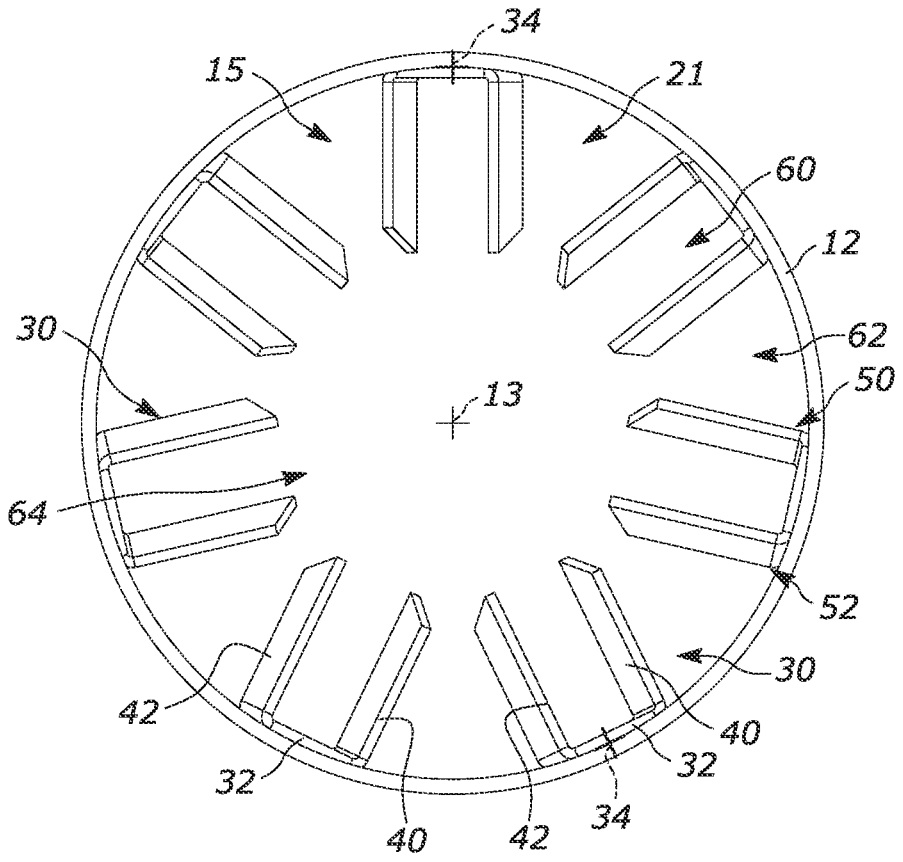
FIG. 3 is a top view of the heat exchanger of FIG. 2.
Figure 4:
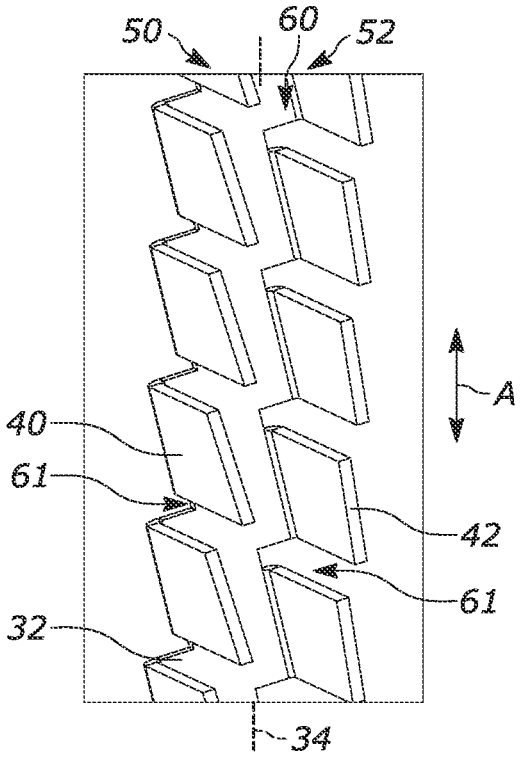
FIG. 4 is an enlarged view of a portion of the heat exchanger.
Figure 5:
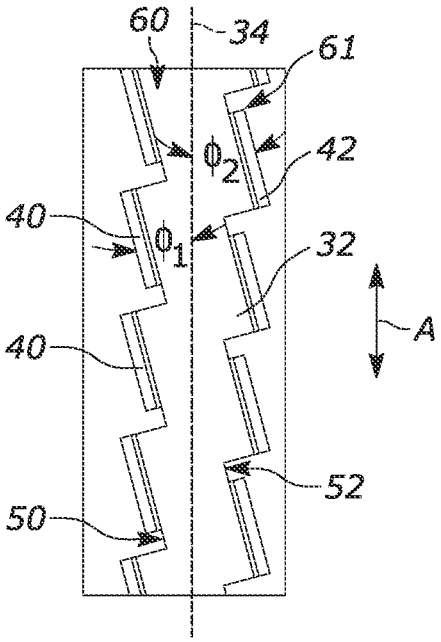
FIG. 5 is a front view of the portion of FIG. 4.

Strips 30 are provided within the passage 15. In one example, the strips 30 have the same length L (parallel to the length of the tube 12) and are longitudinally aligned with one another with in the tube 12. The strips 30 can be positioned closer to the outlet end 19 of the tube 12 than the inlet end 17. As shown in FIGS. 2-4, each strip 30 extends along a centerline 34 from a first end 36 to a second end 38.

Each strip 30 is illustrated as a single, continuous element spanning the length L. However, multiple, discrete strips 30 could alternatively cooperate to span the length L or substantially span the length (not shown). When multiple strips 30 span the length L, it will be appreciated that these strips can all be aligned along the common centerline 34 or one or more strips could be circumferentially offset from one another about and along the common centerline (not shown).

In any case, the strips 30 are identical so the description is limited to a single strip in the interest of brevity. The strip 30 includes a base 32 having opposing sides 50, 52. The centerline 34 of the strip 30 can be straight (as shown), curved, helical, spiral, etc. (not shown). Fins 40, 42 are provided on each side 50, 52, respectively, of the base 32. The fins 40, 42 can be rectangular, square, triangular, round, etc. A passage or channel 60 extends between the fins 40, 42 along the length L of the strip 30. The fins 40, 42 therefore cooperate with the base 32 to give the strip 30 a generally U-shaped longitudinal cross-section.

The fins 40 on the side 50 are spaced both longitudinally (along the centerline 34) and laterally (transverse to the centerline) from one another to form gaps 61. Similarly, the fins 42 on the side 52 are spaced both longitudinally and laterally from one another to form gaps 61. In each case, the gaps 61 extend from outside the strip 30 to the channel 60.

The fins 40 on the side 50 extend parallel to one another and can extend at an angle $\phi_1$ relative to the centerline 34. The fins 42 on the side 52 extend parallel to one another and can extend at the angle $\phi_2$ relative to the centerline 34. The angles $\phi_1$, $\phi_2$ can be the same or different on each strips 30 and/or between strips.

The fins 40 can extend parallel to the fins 42 (as shown) or be angled relative to one another (not shown). The fins 40 can be offset in the longitudinal direction from the fins 42. The number of fins 40, 42 used, as well as the exact shape of the fins, can be adjusted to vary the restricting and turbulating characteristics of the heat exchanger 10. To this end, it will be appreciated that fins 40 or 42 can be provided on only one side 50, 52 of the base 32 (not shown). In this configuration, the strip 30 has an L-shaped longitudinal cross-section instead of the generally U-shaped cross-section shown.

As shown in FIG. 3, the strips 30 are arranged in the passage 15 so as to collectively encircle the centerline 13 (FIG. 3). To this end, the bases 32 are positioned radially outward of the respective fins 40, 42 and are secured to the inner surface of the tube 12 in a known manner, e.g., fasteners, welding, etc. The fins 40, 42 extend radially inward from the base 32 toward the centerline 13. As shown, the strips 30 are symmetrically arranged about the centerline 13. Other arrangements are contemplated. In any case, the fins 40, 42 of adjacent strips 30 define longitudinally extending channels 62 therebetween. The fins 40, 42 cooperate to define a central passage 64 in the tube 12 that extends unobstructed along the centerline 13.

Returning to FIG. 1, in operation the gas burner 18 heats gases that move upward in the manner indicated by the arrows F through the partition 23 and into the channels 60 between fins 40, 42 on the same strips 30, the channels 62 between adjacent strips 30, and the central passage 64. In each case, heat from these gases F is conducted radially outward through the tube 12 to heat the water in the water heating chamber 22. That said, the heated gases flow through the channels 60, 62, thereby greatly increasing heat transfer through the tube 12 and into the heating chamber 22. The heated gases flow the entire length of the tube 12 and are exhausted through the vent system 25.

Figure 6:
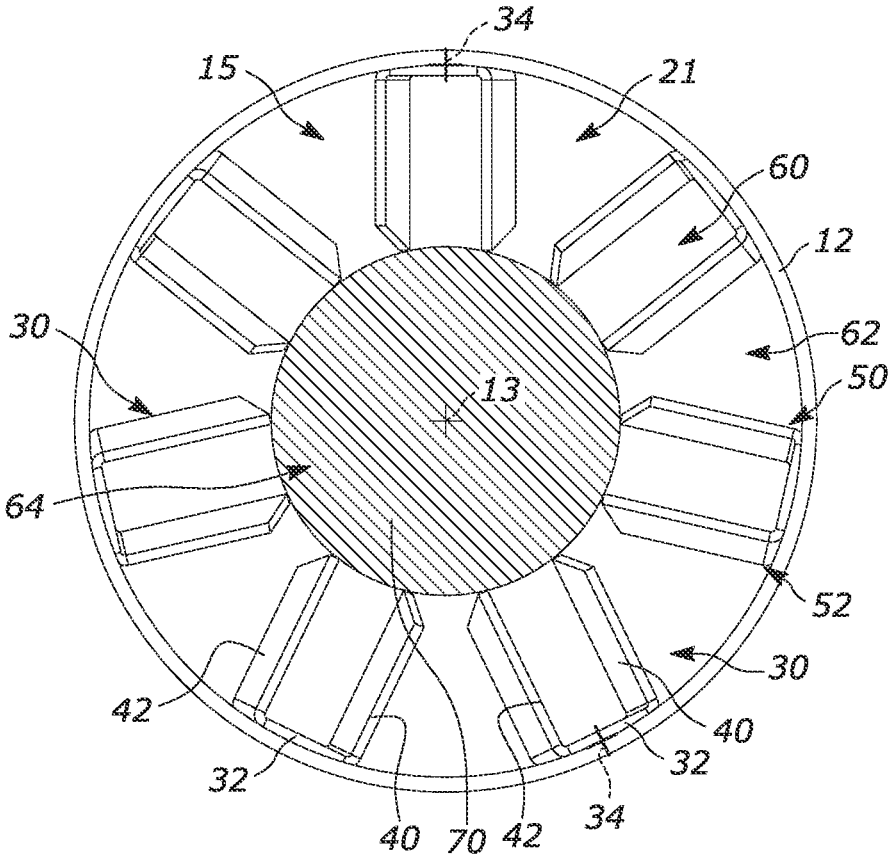
FIG. 6 is a front view of a modified version of the portion of FIG. 4.

In another example shown in FIG. 6, the central passage 64 can be blocked with a plate, cap, etc. (indicated at 70) at the second ends 38 of the strips 30 to force the flue gases F to flow only through the channels 60, 62 and not through the central passage. Alternatively, a tube having a closed end (not shown) is positioned in the central passage 64 adjacent the second ends 38. Such a tube can extend along the centerline 13 part of the length of the tube 12 or the entire length thereof, depending on the pressure drop/heat transfer desired in the heat exchanger 10. In any case, blocking the central passage 64 would increase the percentage of flue gasses that must flow through the more tortuous path between and/or around the fins 40, 42.

It will be appreciated that the number of strips, positioning of strips relative to another, positioning of strips relative to the centerline of the tube, the number of fins on each strip, the positioning/angle of each fin, and/or the length of each strip can be tailored to provide desired heat transfer characteristics for the heat exchanger.

The heat exchanger shown and described herein is advantageous in providing a tailored, more tortuous flow path for flue gases through the tube, thereby increasing the heat transfer characteristics of the heat exchanger. The strips have a greater flue gas contact area than individual tabs or projections and are also easier to manufacture/install compared to existing heat transfer structures for tubular water heater heat exchangers. More specifically, the cumulative surface area contacted by the flue gas in the heat exchanger shown and described herein is increased by adding fins to one/both sides of the base.

What have been described above are examples of the present invention. It is, of course, not possible to describe every conceivable combination of components or methodologies for purposes of describing the present invention, but one of ordinary skill in the art will recognize that many further combinations and permutations of the present invention are possible. Accordingly, the present invention is intended to embrace all such alterations, modifications and variations that fall within the spirit and scope of the appended claims.

What is claimed is:

1. A heat exchanger for a water heater having a burner, comprising:

a tube extending longitudinally along a centerline from a first end adjacent the burner to a second end and defining a passage; and strips extending within the passage and arranged about the centerline, each strip including a base and fins extending from opposite sides of the base and bent along fold lines to extend radially towards the centerline such that flue gases from the burner flow from the first end to the second end of the tube and in channels between the fins, wherein the fold lines of fins on opposite sides of the base are offset from one another in the longitudinal direction.

2. The heat exchanger recited in claim 1, wherein the fins are angled relative to a centerline of the strip.

3. The heat exchanger recited in claim 1, wherein the fins on opposite sides of the base extend parallel to one another.

4. The heat exchanger recited in claim 1, wherein the fins collectively define a central passage through the tube.

5. The heat exchanger recited in claim 4, wherein the central passage is blocked at a bottom end closer to the first end of the tube than the second end of the tube to prevent flue gases from flowing through the central passage.

6. The heat exchanger recited in claim 1, wherein the fins on the same strips define first channels therebetween and the fins on adjacent ships define second channels therebetween.

7. The heat exchanger recited in claim 1, wherein the entirety of the strips is spaced from the centerline of the tube.

8. The heat exchanger recited in claim 1, wherein multiple strips are aligned along a common centerline to define a collective length.

9. A water heater including the heat exchanger recited in claim 1.

10. The heat exchanger recited in claim 1, wherein the fins are arranged in pairs on opposite sides of the base and the fins in each pair are longitudinally offset from one another in the longitudinal direction.

* * * * *